US005762649A

United States Patent [19]

Zimmer

[11] Patent Number: 5,762,649

[45] Date of Patent: Jun. 9, 1998

[54] STORAGE APPARATUS FOR ROUND STENCILS

[75] Inventor: Peter Zimmer, Kufstein, Austria

[73] Assignee: J. Zimmer Maschinenbau Gesellschaft m.b.H., Kufstein, Austria

[21] Appl. No.: 687,569

[22] PCT Filed: Dec. 12, 1995

[86] PCT No.: PCT/AT95/00243

§ 371 Date: Aug. 9, 1996

§ 102(e) Date: Aug. 9, 1996

[87] PCT Pub. No.: WO96/18503

PCT Pub. Date: Jun. 20, 1996

[30] Foreign Application Priority Data

Dec. 12, 1994 [AU] Australia ..... 2305/94

[51] Int. Cl.[6] ..... D06P 5/00; A47F 5/025

[52] U.S. Cl. ..... 8/445; 211/1.56

[58] Field of Search ..... 211/1.56; 101/92, 101/110, 121, 125, 127.1; 8/445

[56] References Cited

U.S. PATENT DOCUMENTS

| | | | |
|---|---|---|---|
| 2,880,878 | 4/1959 | Collette | 211/1.56 |
| 5,161,698 | 11/1992 | Hatouchi et al. | 211/1.56 |

FOREIGN PATENT DOCUMENTS

| | | | |
|---|---|---|---|
| 0161230 | 11/1985 | European Pat. Off. | B41F 15/36 |
| 0418672 | 3/1991 | European Pat. Off. | B41F 35/00 |
| 0444397 | 9/1991 | European Pat. Off. | B41F 15/10 |
| 444397 | 9/1991 | European Pat. Off. | B41F 15/10 |
| 0502240 | 9/1992 | European Pat. Off. | B41F 35/00 |
| 2365440 | 4/1978 | France | B41F 15/36 |
| 1109609 | 6/1961 | Germany . | |
| 1285952 | 12/1968 | Germany . | |
| 2222112 | 11/1973 | Germany | B65G 1/12 |
| 505741 | 4/1971 | Switzerland | B65G 1/04 |

*Primary Examiner*—Margaret Einsmann
*Attorney, Agent, or Firm*—Lorusso & Loud

[57] ABSTRACT

A storage system for round stencils, in particular those used in the textile industry, has two or several holders for releasably holding the round stencils. The holders of the storage system may be moved by a drive, preferably all together. Also disclosed is an application system which has besides the production machine and the storage system a separate washing installation for cleaning the round stencils taken from the production machine. In the washing installation, the round stencils are sprayed from the inside and cleaned from the outside, in particular by brushes, at the same time as they are rotated.

20 Claims, 4 Drawing Sheets

STORAGE APPARATUS FOR ROUND STENCILS

Figure 1:
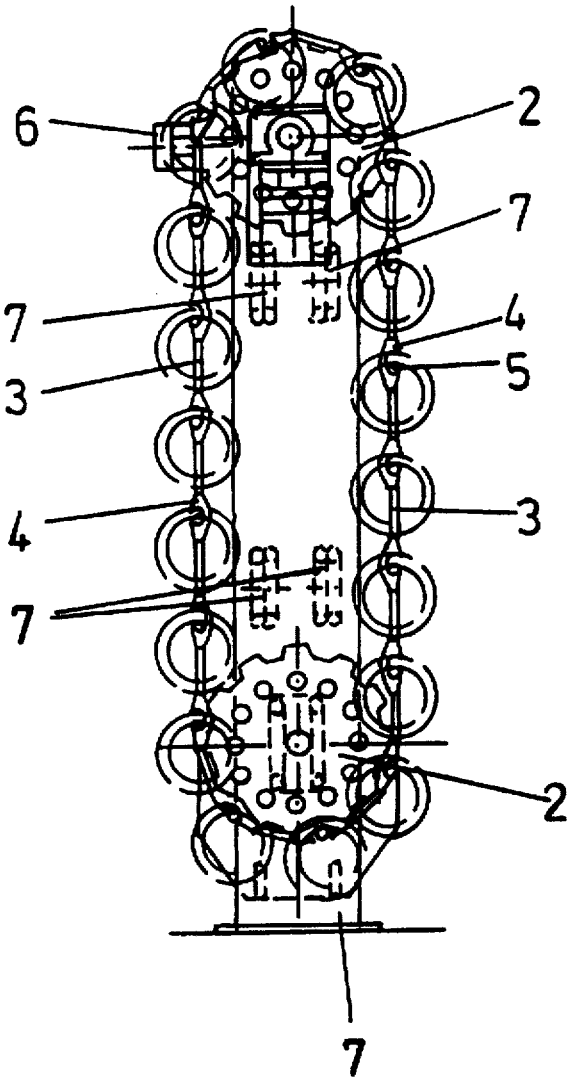

The invention concerns a storage apparatus for round stencils which are used in particular in the textile sector. The invention further concerns an applicator system, in particular for textile printing, and an application process.

For printing on a moving web, in particular for textile printing, it is already best known to arrange a plurality of round stencils in succession in a production apparatus, application of a substance, for example an ink or dye, being effected by means of applicator devices disposed in the interior of the round stencil. The applicator device includes for example an ink tube extending axially through the round stencil and a roller squeegee which presses the ink through the round stencil outwardly onto the textile web. Production apparatuses of that kind achieve high application rates of up to 100 m/minute and above. On the other hand textile printing is switching over to shorter and shorter textile web lengths which are printed upon, with the same pattern. The lower limit nowadays is typically about 500 m. That corresponds to a very short printing time of for example 5 minutes. Then, the pattern is to be changed, which means that the round stencils of the production apparatus must be at least partially exchanged. Hitherto, in the case of a typical production apparatus with a plurality of round stencils, an exchange operation of that kind lasted for a time of the order of magnitude of 45 minutes. In comparison with an extremely short production time of 5 minutes such a stoppage time is unprofitable and there is thus a wish to make such stoppage times shorter. In addition the aim is that the sensitive round stencils can be stored without the risk of damage.

In accordance with the invention that is achieved by two or more holders for releasably holding the round stencils, wherein the holders of the storage apparatus are movable by way of a drive, preferably jointly.

There is therefore proposed a special storage apparatus for round stencils, with which it is possible for a round stencil which has been removed from the production apparatus to be easily fitted into the storage apparatus. By way of the drive for the holders, the storage apparatus can be advanced with a stepwise motion so that a new storage position always comes into the entry/exit location for round stencils while the other round stencils can move away in the same storage apparatus. The round stencils are kept safe in the storage apparatus and protected from damage.

The storage apparatus can be designed for example on the basis of the paternoster principle with an endlessly circulating chain to which the holders for the round stencils are fixed at equal spacings.

Such a storage apparatus, particularly in combination with a production apparatus of the kind set forth in the opening part of this specification, can provide an applicator system with which it is quickly and easily possible to convert the production apparatus. For that purpose for example the procedure can be as follows: a round stencil which has been used, preferably together with the applicator device (in particular the ink tube) disposed therein is removed and it is suspended, preferably by way of the ink tube, in the storage apparatus which is closely adjacent in terms of space. A fresh round stencil is then taken from the storage apparatus and fitted into the production apparatus.

Thereupon a second round stencil is removed from the production apparatus and it is suspended in the storage apparatus at the space which has become free, and once again a fresh round stencil is fitted from the storage apparatus into the production apparatus, etc. When using that method it is possible without unnecessary double movements to convert the production apparatus quickly and easily to a fresh set of round stencils. Therefore, in combination with the production apparatus, the storage apparatus represents a system for faster conversion. It is possible to achieve conversion times per stencil of far less than 1 minute, and it is thus possible considerably to reduce the conventional conversion times.

After a conversion procedure has taken place, soiled round stencils hang in the storage apparatus, and those stencils can now be cleaned in a separate washing apparatus. It is particularly desirable if the washing apparatus is so designed that the round stencils together with the applicator device disposed therein can be cleaned (without therefore separating the applicator device from the round stencil). In that case the washing installation can be so designed that the cleaning fluid in the washing installation is supplied through the applicator device itself, whereby it is possible to clean the round stencil from the interior. Cleaning from the exterior can be effected for example by brushing. However conventional cleaning apparatuses as are described for example in European patent application No. 0 418 672 are also suitable for cleaning the round stencils.

The interposition of a storage apparatus between the production apparatus on the one hand and the washing apparatus on the other hand means that it is possible generally for the operating procedure involved in printing with round stencils to be speeded up and at the same time it is possible to ensure that the round stencils are treated carefully and gently. Overall therefore it is preferably possible to construct a system which is not only optimised in regard to the actual production apparatus but which also takes account of optimised assembly and dismantling as well as cleaning of the round stencils.

Further advantages and features of the invention are described in greater detail with reference to the following specific description.

Figure 2:
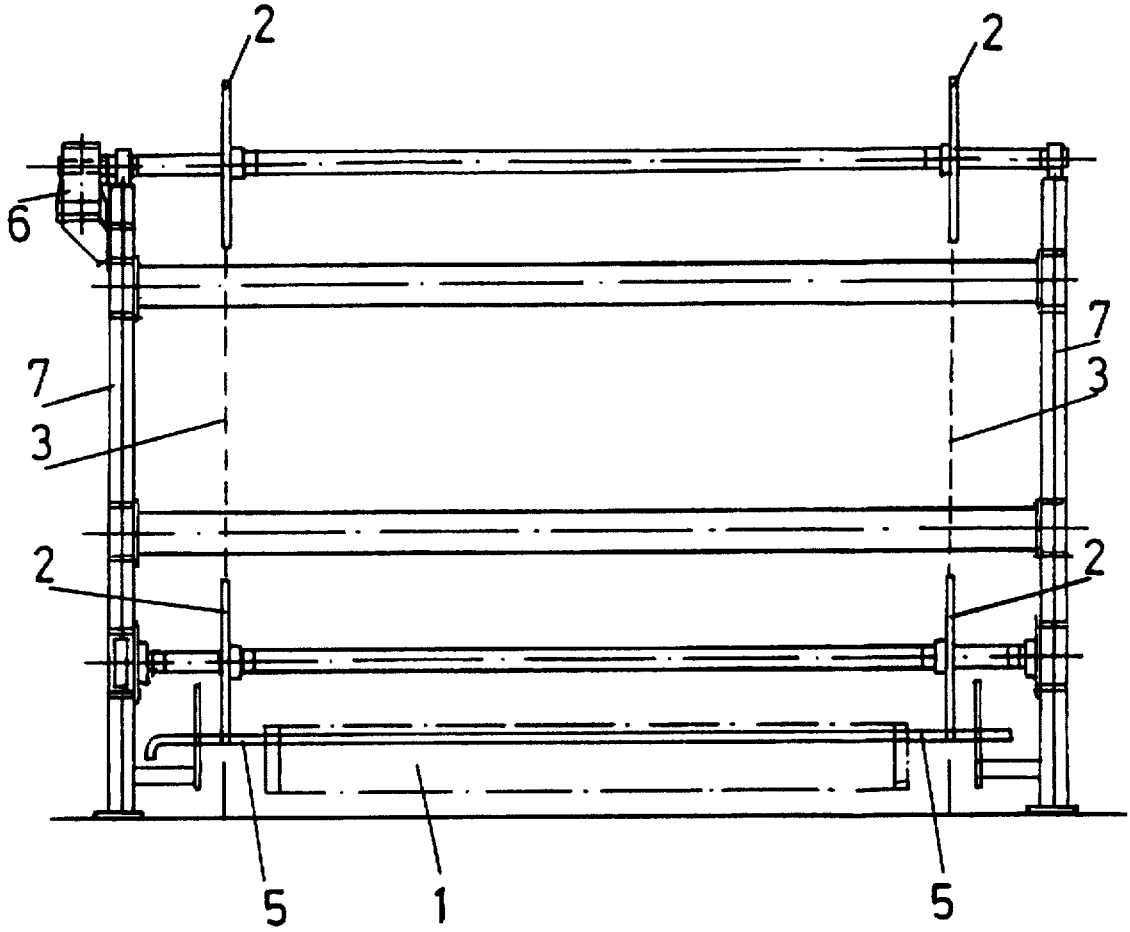
Figure 3:
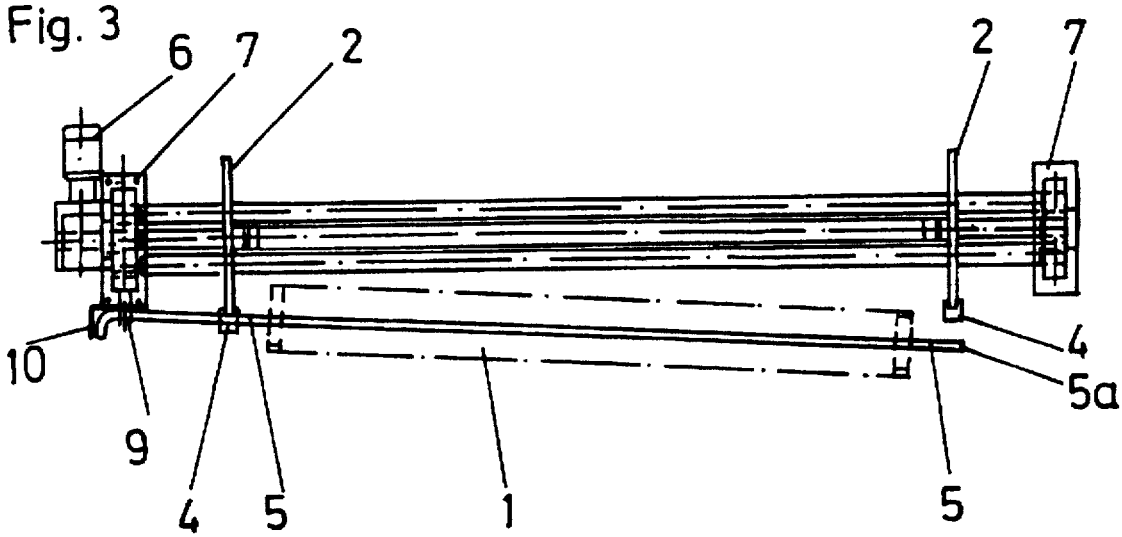
Figure 4:
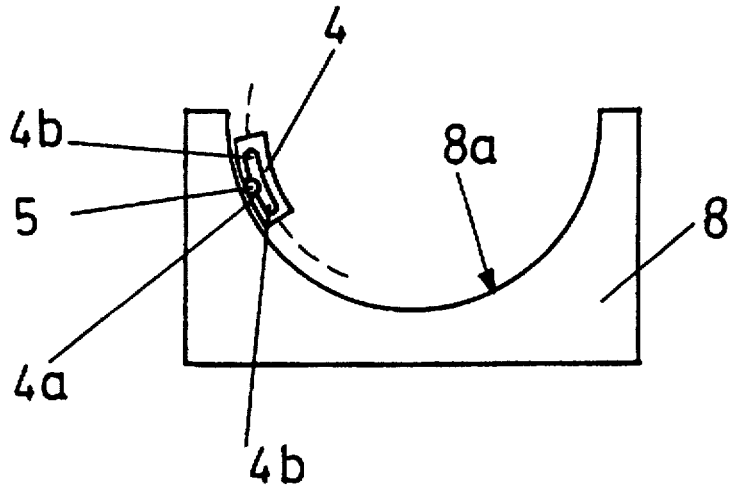
Figure 5:
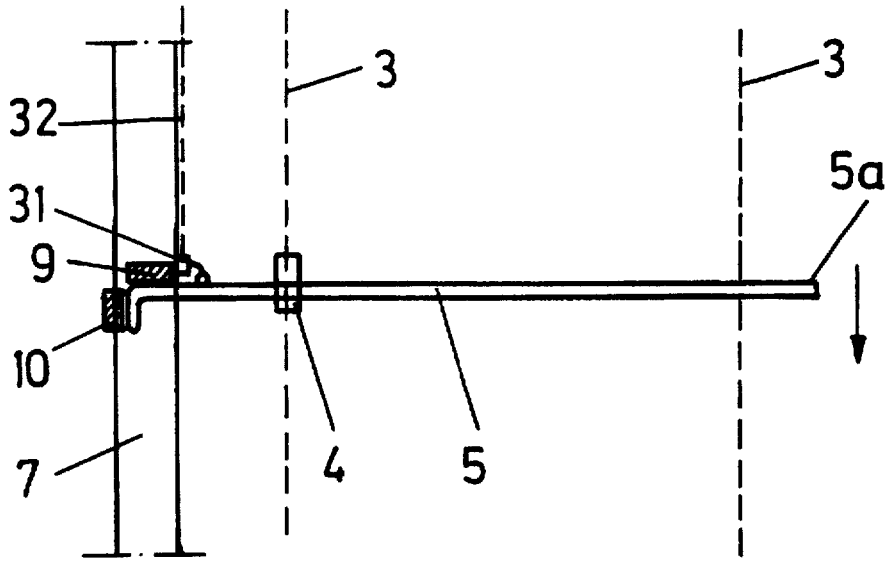
Figure 6:
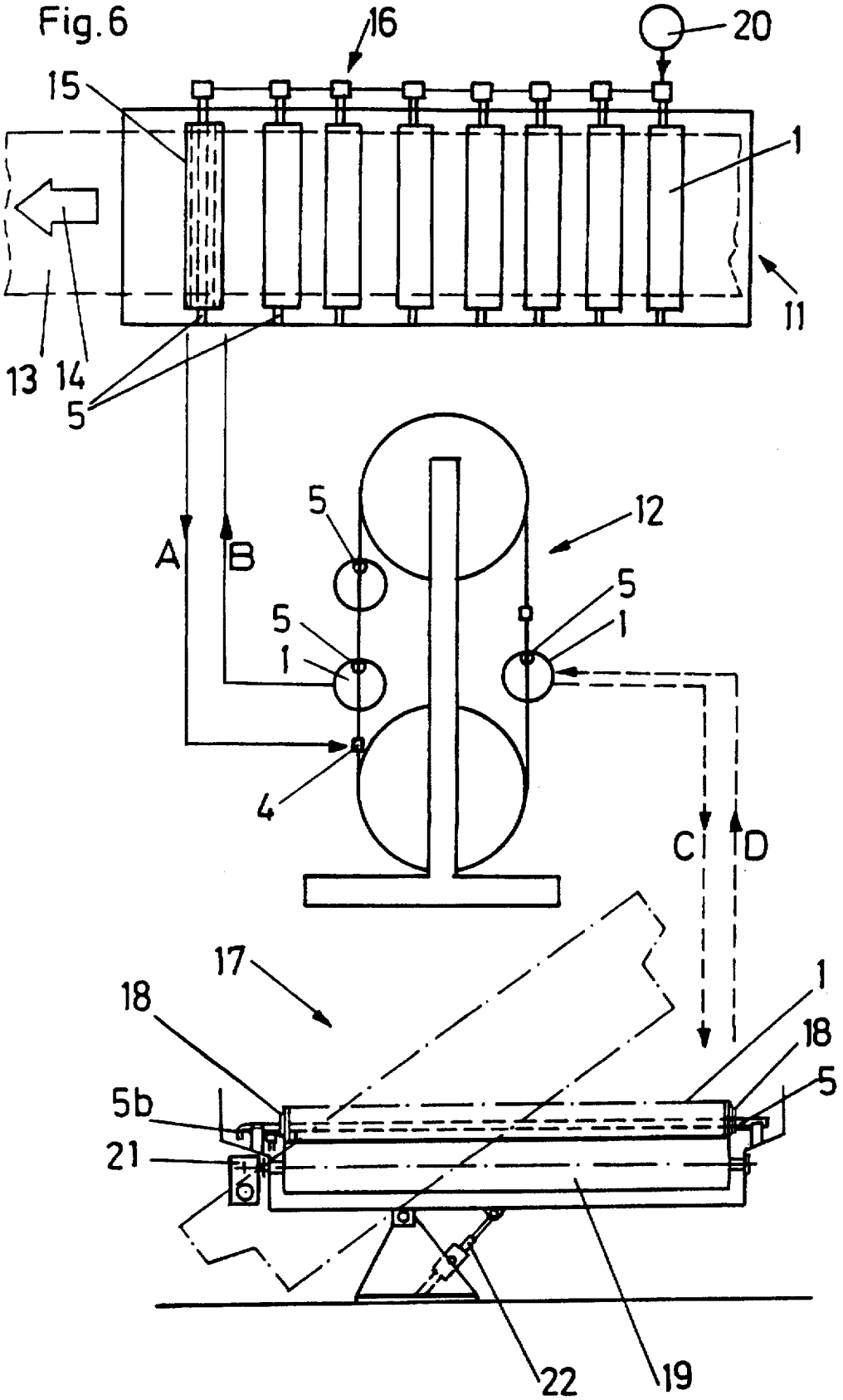

FIG. 1 shows a diagrammatic side view of an embodiment of a storage apparatus according to the invention, FIG. 2 shows a diagrammatic front view of a storage apparatus according to the invention, without showing the chains and individual holders, FIG. 3 shows a plan view of a storage apparatus according to the invention with an ink tube disposed in an assembly/dismantling position, FIG. 4 shows a guide device in the region of a direction-changing wheel, FIG. 5 shows a diagrammatic front view of an ink tube which is suspended in the assembly/dismantling position, and FIG. 6 shows a complete applicator system with a production apparatus, a storage apparatus and a washing installation.

The storage apparatus for round stencils, as shown in FIGS. 1 through 3, is constructed on the basis of the paternoster principle, with two endless link chains 3 being guided around direction-changing wheels. Holders 4 for carrying the ink tube 5 of a round stencil 1 are mounted on the link chain 3.

The holders 4 serve for releasably holding the round stencils, in which respect, in the illustrated embodiment, this is achieved in a particularly simple manner by the ink tube 5 of a round stencil being simply fitted into two respective open holders 4.

The drive is provided by way of a servomotor 6 which is drivable with a stepping movement. By way of suitable transmission arrangements the servomotor 6 drives the two upper direction-changing wheels 2. The direction-changing wheels are mounted on a stationary frame 7.

In order to permit a round stencil to be quickly fitted into the storage apparatus or quickly removed therefrom, it is provided that the holders 4 are of a closure-less configuration. For that purpose, the holders 4 shown in FIGS. 1 and 4 simply have at the front an insertion slot 4*a*which divides in the holder 4 into two oppositely disposed holding slots 4*b*. In the vertical portions of the paternoster arrangement of the storage apparatus the ink tube 5 which functions as a carrier for the round stencil, due to its own weight or the weight of the round stencil, lies in one of the two holding slots 4. As the holder 4 is of a closure-less configuration in order to permit the ink tube 5 to be easily fitted into and removed from same, the ink tube 5 would drop out of the holder in the region of the lower direction-changing wheel 2. In order to avoid that, a preferred embodiment provides that a guide device 8 which is fixed in position is disposed concentrically outside the path of the holders 4. Those guide devices 8 prevent the round stencils or the ink tubes 5 from falling out of the open holder 4. For that purpose the guide devices have guide surfaces 8*a*. In the region of the direction-changing wheels 2 the guide devices 8 extend concentrically with respect thereto. Low coefficients of friction with a high level of resistance can be achieved by means of guide devices of plastic material, in particular polyamide.

In the embodiment shown in FIGS. 3 and 5, a holding means 9 for receiving an ink tube 5 of a round stencil 1 is arranged on the support frame 7 of the storage apparatus, wherein the ink tube 5 is held securely in position by the holding means 9, which is fixed with respect to the support frame 7, and a stationary holder 4 of the storage apparatus, as is shown in FIG. 3 with a round stencil fitted thereon and in FIG. 5 without a round stencil. In the plan view shown in FIG. 3 the ink tube 5 projects inclinedly from the storage apparatus so that the projecting free end 5*a* of the ink tube 5 is freely accessible for assembly and dismantling of the round stencil 1.

The ink tube 5 is held in the holder 4 and the holding means 9 with a self-clamping action, due to the weight of the ink tube 5 itself. In the holder 4 the ink tube 5 lies thereon from above while in the holding means 9 which can be in the form of a simple abutment the ink tube 5 bears against same from below. By virtue of the long overhang in the direction towards the free end 5*a* therefore the ink tube can be held in position simply with a clamping action. An abutment 10 facilitates axial positioning of the ink tube. A sensor 31 which outputs control signals by way of the line 32 blocks the drive 6 if an ink tube 5 is in the assembly/dismantling position shown in FIG. 5 or FIG. 3. That assembly/dismantling position serves to fit onto an ink tube 5 a round stencil together with the usual lateral clamping discs or drive discs, or if necessary to remove the round stencil from the ink tube. In that case the ink tube 5 is held in an exact position by the holders 4, 9, which facilitates damage-free assembly and dismantling of the round stencil 1. After the assembly or dismantling operation the round stencil together with the ink tube 5 can be brought out of engagement with the holding means 9 by simply pulling it in the axial direction (towards the right in FIG. 3) out of the holding means 9, and easily fitted into the second holder 4 in suspended relationship therein (normal storage position).

The storage apparatus according to the invention may be particularly well combined with a production apparatus, in particular for textile printing, in which one or more substances is applied to a moving web of material by means of applicator devices, through two or more removable and interchangeable round stencils 1. For that purpose, the storage apparatus according to the invention which is generally identified by reference numeral 12 is simply set up in the spatial vicinity of the production apparatus 11. In the illustrated embodiment the production apparatus 11 has eight round stencils 1, by means of which a web of material (textile web 13) which is moved in the direction of the arrow 14 can be printed upon with given patterns in different colors. Disposed in the interior of the round stencils 1 is a per se known applicator device 15 which is supplied with ink by way of a distributor system 16 and an ink tube which is passed through the round stencils 1. The applicator device 15 is not shown in greater detail. It can correspond to the state of the art and for example may have a roller squeegee which is pressed against the stencil magnetically in order to urge the ink supplied by way of the ink tube 5 through the round stencil 1 onto the web of material 13.

It is particularly desirable if the storage apparatus 12 can accommodate by at least one round stencil 1 more than the maximum provided on the production apparatus 11. More specifically, the storage apparatus 12 then always has a free place which makes it possible for a soiled round stencil together with the applicator device 15 therein (including the ink tube 5) initially to be removed from the production apparatus 11 and moved as indicated by the path A (FIG. 6) to a free place in the storage apparatus 12. Thereupon, following the path B, a fresh round stencil 1 can be fitted into the production apparatus 11 at the same location. During that fitting operation the drive 6 can produce further stepwise movement of the round stencils of the storage apparatus, through one position, in the counter-clockwise direction. Then, in the same manner, the other used and soiled round stencils 1 of the production apparatus 11 can be put into the storage apparatus 12 and from there the fresh round stencils can be fitted into the production apparatus 11.

While the ink tube 5 extends on the axis of the cylindrical round stencil 1 in the operative position of around stencil 1 in the production apparatus 11 or in the washing installation 17 which is still to be described hereinafter, in the storage apparatus 12 the cylindrical round stencil 1 hangs directly with its inner peripheral edge on the ink tube 5 which is held horizontally. It therefore does not need to be held there centrally by lateral clamping discs or end rings. Therefore, on the storage apparatus 12, the ink tube is outside the axis of the cylindrical round stencils 1. They can simply hang freely on the horizontal ink tubes.

The upper part of FIG. 6 described how the storage apparatus 12 according to the invention can be usefully combined with a production apparatus 11. In order to provide a complete applicator system it is desirable if, in addition to the production apparatus 11 and the storage apparatus 12, there is also a separate washing installation 17 for cleaning round stencils 1, in which the round stencil 1 on the one hand is sprayed from the inside and on the other hand is also cleaned from the outside by brushes 19 with simultaneous rotary movement. In principle it is also possible to use washing installations in accordance with the state of the art, for example that which is described in European patent application No 0 418 672. In that case rotating cylindrical brushes clean the outside of the round stencil while a spray tube which passes through the round stencil over the entire length thereof supplies cleaning fluid. Particularly desirable however is a preferred new embodiment in which the round stencil 1 together with the applicator device arranged therein (in particular the ink tube 5 and possibly a roller squeegee etc) is removable from the production apparatus 11 and can be introduced as a unit into the washing installation, the feed of cleaning fluid in the washing installation 17 being effected through the applicator device. In the production apparatus 11 therefore the substance to be applied, for example an ink, is supplied through the applicator device. In the washing installation 17 a cleaning fluid is supplied through the same applicator device. For that purpose, preferably the same pump 20 can be used as in the production apparatus 11, by way of suitable releasable hose couplings. The pump 20 then pumps cleaning fluid into the connecting portions 5b of the ink tube 5 from a supply container (not shown) for cleaning fluid and suitable hose connections. In the washing installation the drive is produced by way of the motor 21. The washing installation can also advantageously be pivoted up as a unit by way of a hydraulic cylinder 22.

In the washing installation 17 the round stencils 1 which are removed from the storage apparatus 12 along the path C can be individually cleaned and then put back into the storage apparatus 12 again by moving along the path D so that finally clean round stencils are again stored in the storage apparatus. It is however also possible for the clean round stencils then to be deposited in another storage apparatus. There is therefore not a 1:1 association between the production apparatus 11, the storage apparatus 12 and the washing installation 17. It is for example perfectly possible for two production apparatuses 11 to have a common larger storage apparatus 12. Conversely it is also perfectly well possible for two or more storage apparatuses to be associated with a production apparatus or washing installation.

The invention concerns not only the above-described storage apparatus and the above-described applicator system, but also an application process, in particular for textile printing, wherein firstly on a production apparatus one or more substances is applied by means of applicator devices through removable and interchangeable round stencils. In accordance with the invention it is provided that the used and soiled round stencils, preferably together with the applicator devices disposed therein, are removed from the production apparatus and deposited in a storage apparatus with driven movable holders for the round stencils, and that clean fresh round stencils are taken from a and preferably the same storage apparatus and fitted into the production apparatus. Such a process permits substantially shorter setting times than was hitherto possible. Accordingly the efficiency of the applicator system can be overall substantially increased.

Preferably the operating procedure can be such that firstly a soiled round stencil is taken from the production apparatus and fitted into the storage apparatus and that then a fresh round stencil from the storage apparatus is fitted into the production machine at the location which has come free. Conversion of the production apparatus to new round stencils is therefore effected step by step.

A particularly complete application process provides that the soiled round stencils are cleaned, preferably individually, in a washing installation, after intermediate storage in a storage apparatus. Thereafter the round stencils can be put into the same or another storage apparatus.

I claim:

1. A storage apparatus for round stencils comprising:

an endless drive;

at least two direction-changing wheels for guiding said endless drive along a predefined path;

two or more holders attached to said endless drive for releasably holding the round stencils, each holder having an open insertion slot therein for receiving one of said round stencils; and at least one guide device arranged concentrically to at least one of the direction-changing wheels, said guide device preventing the round stencils from falling out of the open insertion slots of the holders when said round stencils pass around said direction-changing wheels.

2. A storage apparatus as set forth in claim 1, characterized in that said at least one guide device has a guide surface adjacent to said predefined path.

3. A storage apparatus as set forth in claim 1, characterized in that said at least one guide device comprises plastic material.

4. A storage apparatus as set forth in claim 1, characterized in that said endless drive comprises at least one chain.

5. A storage apparatus as set forth in claim 1, characterized in that the open insertion slot divides the holder into two oppositely disposed holding slots.

6. A storage apparatus as set forth in claim 1, characterized in that two of said holders disposed at a same vertical height each hold one of said round stencils in a horizontal position.

7. A storage apparatus as set forth in claim 1, wherein each of said round stencils comprises an ink tube which is passed therethrough and which projects therefrom at both ends, and wherein said open insertion slot of each holder is adapted to receive said ink tube.

8. A storage apparatus as set forth in claim 1, wherein each of said round stencils comprises an ink tube which is passed therethrough and which projects therefrom at both ends, and wherein each round stencil is supported in the storage apparatus hanging directly with an inner peripheral edge thereof on an ink tube, said ink tube having first and second ends disposed within first and second ones, respectively, of said open insertion slots to thereby support said ink tube horizontally between first and second ones of said holders.

9. A storage apparatus as set forth in claim 1, characterized in that the storage apparatus has a support frame on which a holding means for receiving an ink tube of a round stencil is arranged, wherein the ink tube can be held securely in position by said holding means, which is fixed with respect to the support frame, and a stationary one of said two or more holders.

10. A storage apparatus as set forth in claim 1, characterized in that the storage apparatus has a support frame on which a holding means for receiving an ink tube of a round stencil is arranged, wherein the ink tube is held by the holding means, which is fixed with respect to the support frame, and by a stationary one of said two or more holders, said ink tube thereby projecting inclinedly from the storage apparatus so that a projecting free end of the ink tube is freely accessible for assembly and dismantling of the round stencil.

11. A storage apparatus as set forth in claim 1, characterized in that the storage apparatus has a support frame on which a holding means for receiving an ink tube of a round stencil is arranged, wherein disposed in the region of the holding means, which is fixed with respect to the support frame, is a sensor for detecting the ink tube when the ink tube is fitted into said holding means, and wherein a signal output by the sensor blocks the endless drive for said holders when the ink tube is held in the holding means.

12. An applicator system comprising a production apparatus in which a substance is applied to a moved web of material by means of an applicator device through two or more removable and interchangeable round stencils, characterized in that a storage apparatus for round stencils according to claim 1 is arranged beside the production apparatus.

13. An applicator system as set forth in claim 12, characterized in that the storage apparatus can accommodate more round stencils by at least one round stencil than the maximum provision on the production apparatus.

14. An applicator system as set forth in claim 12, characterized in that besides the production apparatus and the storage apparatus there is a separate washing installation for cleaning round stencils which have been removed from the production apparatus, in which washing installation a round stencil is sprayed from the inside and with simultaneous rotary movement is also cleaned from the outside.

15. An applicator system as set forth in claim 12, characterized in that the round stencil together with the applicator device arranged therein is removable from the production apparatus and can be introduced into a separate washing installation, wherein a feed of cleaning fluid in the washing installation is effected through the applicator device.

16. An applicator system as set forth in claim 12, characterized in that besides the production apparatus and the storage apparatus there is a separate washing installation for cleaning round stencils which have been removed from the production apparatus, and wherein a feed of cleaning fluid from the washing installation for cleaning said round stencils is effected by way of a pump which also feeds said substance to the production apparatus.

17. An application process, wherein firstly on a production apparatus one or more substances is applied to a web of material by means of applicator devices which are an integral part of removable and interchangeable round stencils, characterized in that soiled round stencils are removed from the production apparatus and fitted in a storage apparatus with driven movable holders for the round stencils according to claim 1, and that clean round stencils are taken from the said storage apparatus and fitted into the production apparatus.

18. A process as set forth in claim 17, characterized in that after a round stencil has applied one or more substances to said web of material said round stencil is solid and is taken from the production apparatus and fitted into the storage apparatus and then a clean round stencil from the storage apparatus is fitted into the production apparatus at a location which was previously occupied by said soiled round stencil.

19. A process as set forth in claim 17, further characterized in that the soiled round stencils are cleaned in a washing installation after intermediate storage in said storage apparatus.

20. A process as set forth in claim 19, further characterized in that the soiled round stencils are put into the storage apparatus again after the washing operation.

* * * * *